US006178711B1

(12) United States Patent
Laird et al.

(10) Patent No.: US 6,178,711 B1
(45) **Date of Patent: *Jan. 30, 2001**

(54) COMPACTLY-SHIPPED SITE-ASSEMBLED CONCRETE FORMS FOR PRODUCING VARIABLE-WIDTH INSULATED-SIDEWALL FASTENER-RECEIVING BUILDING WALLS

(76) Inventors: Andrew Laird, 1620 Saint James Ct., Carlsbad, CA (US) 92008; Alex Laird, P.O. Box 666, Crested Butte, CO (US) 81224

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/739,725

(22) Filed: Nov. 7, 1996

(51) Int. Cl.[7] ..... E04B 2/34

(52) U.S. Cl. ..... 52/427; 52/357; 52/358; 52/363; 52/379; 52/424; 52/570

(58) Field of Search ..... 52/426, 427, 357, 52/379, 358, 363, 570, 424

(56) References Cited

U.S. PATENT DOCUMENTS 3,751,867 * 8/1973 Layne ..... 52/426
4,924,641 * 5/1990 Gibbar, Jr. ..... 52/204
4,936,540 * 6/1990 Boeshart ..... 249/316
4,938,449 * 7/1990 Boeshart ..... 249/216
4,967,528 * 11/1990 Doran ..... 52/309.12
5,611,183 * 3/1997 Kim ..... 52/426
5,803,669 * 9/1998 Bullard ..... 405/257

* cited by examiner

*Primary Examiner*—Richard Chilcot
*Assistant Examiner*—Yvonne M. Horton
(74) *Attorney, Agent, or Firm*—Fuess & Davidenas

(57) ABSTRACT

Generally large, typically eight feet by two inches by ten or sixteen or twenty-four inches, sidewalls for modular concrete forms are easily, efficiently and economically produced by cutting and by routing sheet-type polymeric material, preferably polyurethane or expanded polystyrene foam. Metal connecting members are produced in standard sizes by cutting and bending sheet steel and/or wire. The sidewalls and connecting members are transported to a building site tightly and compactly in pieces, and then flexibly assembled into precision wall forms at the site with good efficiency at any scale. The wall forms so assembled define a cavity into which reinforcing steel rod, electrical and/or communications conduit, plumbing, etc., may be entered. Concrete is poured into the cavity to create a wall having the form sidewalls as its permanent surfaces. These surfaces have and present visible, regularly-spaced sheet steel strips suitable to receive and to engage sheet metal screws for mounting anything, including more sheet-type construction materials such as wallboard or paneling, to the wall. The thickness of the concrete wall is predetermined by the dimensions of its metal sidewall-connecting members, and may easily be varied such as during the fabrication of lower to upper wall courses of a multi-story building.

11 Claims, 3 Drawing Sheets

FIG. 1
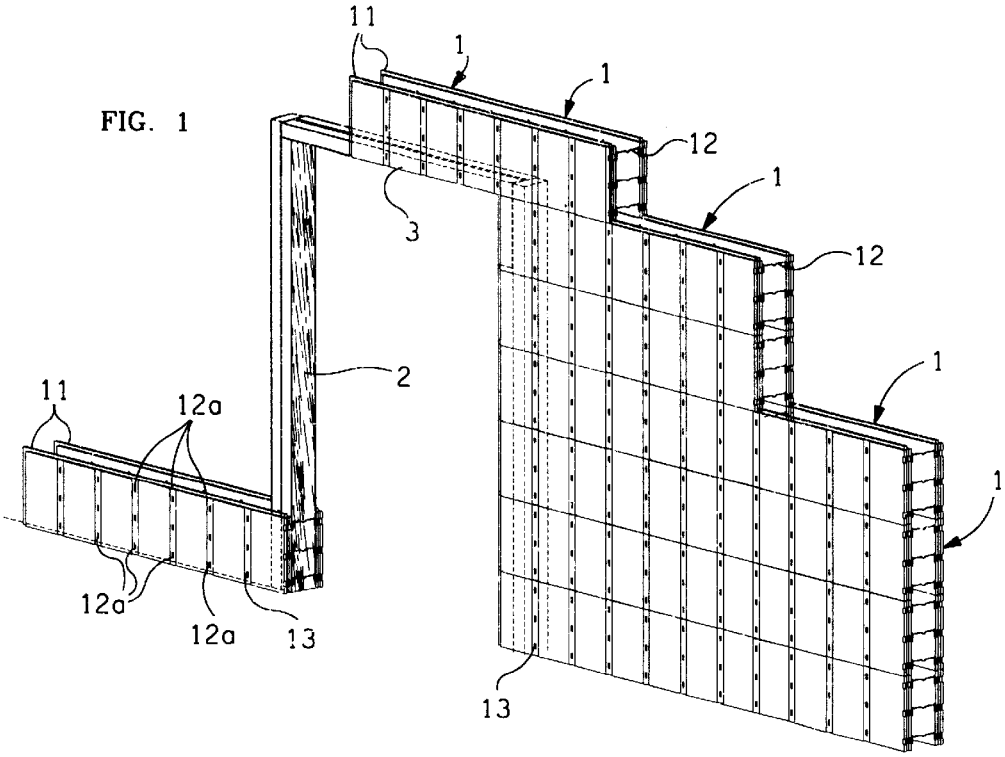
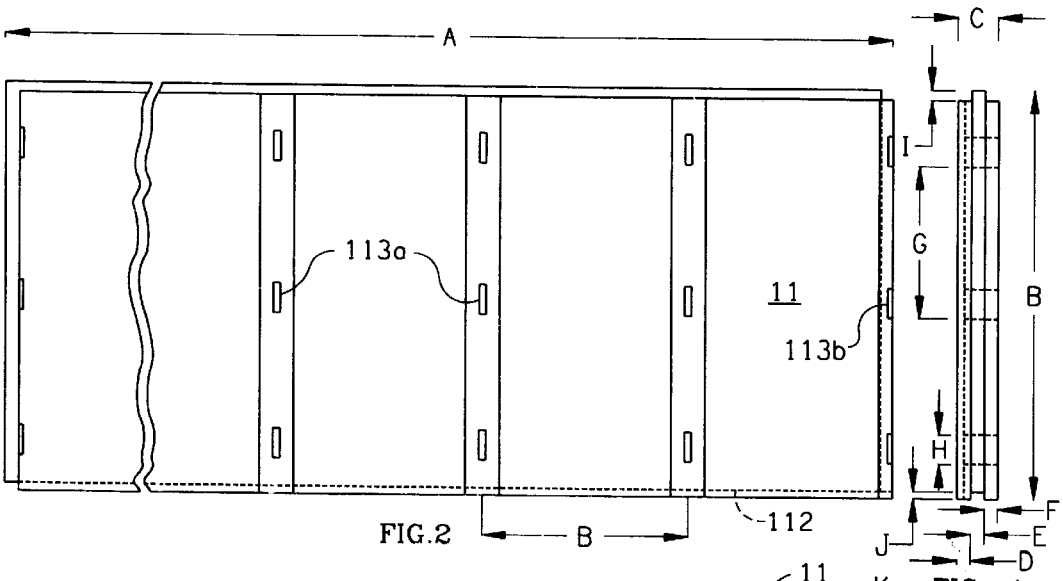
FIG.2
FIG. 4
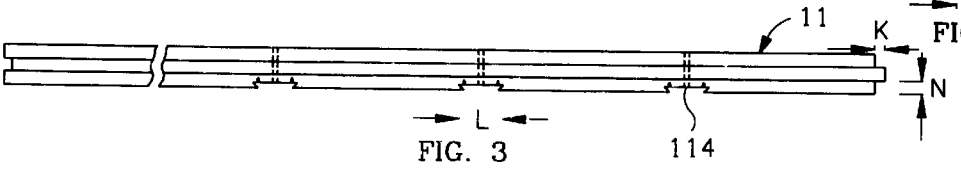
FIG. 3

COMPACTLY-SHIPPED SITE-ASSEMBLED CONCRETE FORMS FOR PRODUCING VARIABLE-WIDTH INSULATED-SIDEWALL FASTENER-RECEIVING BUILDING WALLS

BACKGROUND OF THE INVENTION

1. Field of the Invention

The present invention generally concerns self-supporting, molded construction forms used in the building industry.

The present invention particularly concerns building forms made from a large sheets of low-density plastic or polymeric material, often polyurethane or polystyrene, that are held in a spaced-parallel relationship by metal connecting members which are commonly made from steel. Cavities of the plastic and steel forms so assembled are filled with wet concrete. After the concrete is cured, the forms become a permanent part of the building's walls.

2. Description of the Prior Art 2.1 State of the Prior Art

Construction forms have been manufactured from polymeric material, often polyurethane or polystyrene, which expands within a mold to yield a rigid, low-density, foamed plastic forms. The forms typically have a tongue and groove arrangement on all sides to permit identical forms to be placed on either side, above, or below a one form. Extended vertical and/or horizontal cavities are created between adjacent forms. Diverse items from reinforcing steel rod (re-bar) to conduit may be passed lengthwise into these cavities, and even brought to the surfaces of the forms as desired. The cavities are filled with wet concrete, forming walls of contiguous concrete. The forms are left in place, instead of being removed, when the concrete cures. In this manner the forms are supported by, as well as supporting of, the concrete, and serve as insulation to the walls of the completed building structure.

One important problem with such forms has previously been solved. This problem is the necessity of providing mechanical support for finished material such as furring strips, paneling, wall board, etc. attached to a wall that is formed by use of the forms. One early concrete form solving this problem is shown in U.S. Pat. No. 4,223,501 for a CONCRETE FORM to DeLozier. The DeLozier concrete form has been sold commercially since approximately Sep. 23, 1980; the issuance date of the DeLozier patent. In the DeLozier concrete form, sidewalls of foam polymeric material are connected by transverse connecting members. The connecting members have and present at each of their ends a lip that is parallel to the surface of the wall, and that is suitable to engage a sheet metal screw.

In their preferred form, each connecting member of the DeLozier concrete form is preferably made from a single piece of sheet material, preferably from cold rolled steel. A central connecting web portion extends between, and is embedded within, sidewall members of the form. First and second imperforate flat attachment flange portions extend perpendicularly from the web portion, and parallel to the sidewalls. These flanges are embedded within the outer surfaces of the sidewall members. In this location they may receive and support fasteners, typically screws, that penetrate the polymeric material of the sidewall members.

A purported improvement to the DeLozier concrete form is taught in U.S. Pat. No. 4,879,855 for an ATTACHMENT AND REINFORCEMENT MEMBER FOR MOLDED CONSTRUCTION FORMS to Berrenberg. In the Berrenberg form the attachment and reinforcement member of a DeLozier-type concrete form has as its central portion expanded web steel. The end portions of this member are bent and fitted with covering strips of solid galvanized steel. The web and galvanized steel are embedded within a construction form during the manufacture of the form. The strips of the solid galvanized steel extend to, and appear, on the outer surfaces of the form. They therein provide attachment services to which any standard type of wall covering such as sheet rock, siding, paneling, lath for stucco, or brick veneer may be attached. These attachment strips are spaced at regular predetermined intervals. They also define the locations of (i) any vertical cavities and/or concrete posts embedded within the wall that is formed by the construction form, and/or (ii) any conduit or other channel material previously placed within the void of the form before the pouring of the concrete wall.

Important to the DeLozier and Berrenberg forms, and to all forms of this nature, the interior of the forms must have and present an array of relatively large openings to permit the ready flow of liquid concrete vertically through several arrayed forms, therein so as to ultimately provide a continuous concrete wall (in which the wall the connecting members are embedded, and to which wall the polymeric material forms the exterior sidewalls). Although the exterior surfaces of the forms are flat, as best suits their function as wall surfaces, the interior surfaces of the DeLozier, Berrenberg and other, like, forms are very complex. The forms produce a concrete wall that, if the polymeric material were to be somehow removed, would have the substantial appearance and surface texture of a waffle. The wall, and a waffle, are in the substantial structure of a grid surface with regular high and low (thick and thin) regions, and with somewhat smoothed undulations between regions. If the polymeric material were to chiseled or scraped off a completed wall, then an undulating concrete surface in an imperforate web pattern would be exposed.

Although the exact nature of the pattern of this concrete surface is not particularly important, it is obviously beneficial that the concrete of the wall should have both (i) no excessively thin or weak points, and (ii) no long straight lines long which the wall material is uniformly thin. In other words, it is not adverse that a common edible waffle should have fracture lines, or at least lines along which relatively thinner material of the waffle may be cut with a fork or knife. However, it is not desirable that a concrete wall should have such "fracture lines". The surface of the concrete wall (as is hidden, and rendered flat, by the polymeric material) would better have the topology of the dimpled surface of a golf ball (rendered planar), or even the traditional smooth surface, than it would the surface of a waffle or cracker that is intended to fracture and to break along pre-existing fracture lines.

The interior voids of the DeLozier, Berrenberg and like forms, and the thickness of the concrete walls produced with these forms, basically vary in thickness over the scale of one connecting member to the next so that this interior void, and the interior surfaces of the form, will well support the full and free flow of concrete into every nook and cranny of the void. However, it is detrimental that the wall defined by the concrete form should vary in thickness over this scale. A wall that has relatively weaker, and relatively stronger, regions does not make the best and more efficient use of the concrete material, because the wall will always fracture at its weakest point, and along its weakest fracture line. One thing that should be avoided—if at all possible consistent with the necessity to flow concrete into the form—are long straight lines of relatively thinner thickness in the resulting concrete wall. These lines are obviously potential fracture sites, and crack lines, in the concrete wall.

Analysis of both the interior of the form and the resulting pattern of the wall that the form with regard to making both the best and strongest possible use of the available construction material (concrete) quickly leads back to the classic smooth-surface, flat, concrete wall. This classic wall—which is readily formed with traditional, normal, planar, concrete forms of wood of the like—has not been producible with the concrete forms of DeLozier and Berrenberg. The present invention will produce the classical smooth, flat concrete wall—only sheathed both sides with polymeric material. This will be the case nonetheless that (i) the polymeric material is strongly permanently attached to the interior concrete, and (ii) the poured concrete from which the wall is made has flowed reliably and well into all voids of the arrayed forms.

If an interior concrete wall made by forms of the present invention was to be, nonetheless to being superior to the "waffle-like" (interior) concrete walls made by the prior art integrating forms of DeLozier and Berrenberg, only as good at stopping cracks and fractures as is the classic, and classically constructed, smooth concrete wall, then the previous four paragraphs might amount to ado about very little. However, a wall made with factory-produced forms in accordance with the present invention will be seen not to be required to be substantially (i) straight and/or (ii) smooth, and may easily and intentionally incorporate diverse complex features of almost any desired nature—instead of the incidental and unintentional, generally undesired features, of the DeLozier and Berrenberg forms.

What might these features be? In the first place, the possible features, and the possible complexity of construction, of walls exist at many scales. Laid-up brick walls and architecture commonly do not much look like concrete walls at large scales on the order of tens of meters, the brick walls being generally more convolute. The convolutions help to stop the propagation of failures at large dimensional scales. Concrete walls and buildings are generally more plain. The forms of the present invention will be seen to permit concrete walls to be easily constructed with many more corners and angles than heretofore, adding strength as well as beauty.

At a smaller scale on the order of meters, the present invention will as show that there are features, generally exotic in nature in that they can be in the form of complex curves, that may desirably be placed in the surface, and in the thickness, of a concrete wall in order to deflect, and to stop, long cracks. These features can be complimentary to, and interactive with, reinforcing re-bar contained within the wall. These features, and these combinations, have not heretofore been seen because they would be prohibitively expensive to produce in a normal concrete wall.

Other important problems with existing forms remain. First, the leading DeLozier and Berrenberg forms are not particularly economical of fabrication. Each form must be individually molded. This is normally done by a custom fabricator, i.e., a fabricator of construction forms, and not by a plastic materials manufacturer. In other words, the sophisticated forms look nothing like any structure in which plastic material is commonly sold in bulk.

It would correspondingly be useful if construction forms could somehow be made from structures, such as plastic sheet and panel, in which plastic material is commonly delivered by plastics manufacturers with no, or minimal, re-work, and wastage.

Second, the connecting members between the sides of the forms are fairly sophisticated with multiple angles, and must be formed prior to be embedded in the form as molded. They must be held in position as the form is molded, and while it cures, and may thus negatively impact the rapidity with which the form molds may be cycled. The connecting members are not particularly economical of fabrication, and typically waste a good deal of material, which wastage may typically be galvanized steel sheet. Indeed, one of the purported advantages of the Berrenberg form is the usage of expanded webbed steel in the center of the form, alleviating a need for galvanized steel sheet throughout.

Accordingly, it would be useful if the metal connecting members of any form were of minimal material cost, simply constructed, and produced with no, or minimal, wastage of metal.

Third, the prior art DeLozier and Berrenberg forms are not particularly economical to ship. They basically serve to enclose a lot of air, which magnifies the volume of shipment. Because of the typically considerable volume of a building's walls that the forms serve to initially define, and ultimately sheath, it is usually not possible to carry all the forms for a modest size concrete building on even the largest truck. Necessary multiple deliveries of forms not only magnify costs but can cause logistical, and staging, problems when not all forms are available to place in position before the pouring of any concrete.

Accordingly, it would be useful if building forms could somehow be made more compact for shipment.

Fourth, the leading prior art molded forms permit highly efficient construction of concrete walls and buildings, but have strong competition. The molded forms permit the layout of sophisticated multi-angled and multi-cornered architecturally-interesting walls. They are amendable to the location of windows and doors. However, many concrete wall buildings—especially the more utilitarian buildings such as warehouses—typically have long expanses of plain wall. The walls are often constructed between reusable forms laid flat upon the ground, and are then hoisted into position and connected one huge wall section to the next. This very efficient modern method of concrete wall and building construction is equally, or more, cost effective than existing molded concrete forms.

If existing concrete forms are not of optimal size, and are generally too small for hugely fast and efficient wall construction, then what would an optimal large size be? And what limitations are encountered in creating and using a form of such a larger size?

In the first place, existing molded forms are not particularly large, and are generally of a size approximately four feet by one and one-half feet by 1 feet (4'×1½'×1'), because any larger molds necessary to make such forms larger become exceedingly expensive. Next, and although a workman could seemingly lift and position something larger than the existing molded forms, there is a limit upon how large a form may become and still be practically and conveniently manipulated by a building construction worker. Finally, if and as the forms grow ever larger, then they sacrifice the flexibility of being readily adaptable to the smaller features of the building, and become difficult and time-consuming to customize to the necessary corners, and door and window openings, of the building.

Logically, it would probably be a good idea if a family of interlocking and interconnecting forms of various sizes were to be available, and/or some way would exist to spit an existing large form into compatible smaller forms. This seems difficult, however. Any proliferation of form types could multiply costs, and logistical complexity. Because the forms must have some innate strength, it does not seem immediately obvious how a form that must "hold together" when large can easily be divided into parts that are uniformly structurally sound.

Any system that would solve the challenge of producing concrete walls efficiently at both large and small scales, and with both great and small differentiation and sophistication in the walls produced, would be useful.

Fifth, and finally, existing molded concrete forms lack any capacity to be scaled in the thickness of the wall produced. A given form produces a wall of a predetermined thickness. In the real world, however, concrete walls desirably vary in thickness for many reasons. Some walls may be upon different stories of a building, with upper story walls being generally thinner than the lower story walls (and vice versa). Load-bearing walls are desirably thicker; non-load-bearing walls are desirably thinner. Walls subject to seismic stress, or in certain alignments, may suitably be thicker than other walls.

Accordingly, it would be useful if a single system of concrete forms could be used to produce, at different times and in different configurations, concrete walls of varying thickness.

2.2 Previous Patents

In greater detail, the aforementioned U.S. Pat. No. 4,223,501 to DeLozier issued Sep. 23, 1980 for a CONCRETE FORM concerns a self-supporting concrete form of foamed polymeric material. A one piece transverse connecting member is provided which mechanically holds fastening members inserted into the form, thereby providing mechanical support for finish material such as furring strips, paneling, etc. The connecting member is formed from one piece of sheet material, preferably cold rolled steel, and comprises a central connecting web portion extending between and embedded in sidewall members of the form, and first and second imperforate flat attachment flange portions extending perpendicularly from the web portion and embedded near the outer surfaces of the sidewall members for receiving and supporting fastening members penetrating the sidewall members. The web portion of the connecting member comprises an array of relatively large openings to permit the flow of concrete through the form units and to provide a high strength web of metal. The connecting members may be arranged in each form unit with one connecting member midway between the longitudinal center and each end of the form unit so that, when the form units are laid up in courses in a staggered array, the connecting members of form units in succeeding courses are aligned.

Also in greater detail, the aforementioned U.S. Pat. No. 4,879,855 to Berrenberg issued Nov. 14, 1989 for an ATTACHMENT AND REINFORCEMENT MEMBER FOR MOLDED CONSTRUCTION FORMS concerns an attachment and reinforcement member for molded construction forms that has a central portion of expanded webbed steel in which the ends are bent to accommodate covering strips of solid galvanized steel. The Berrenberg invention is embedded in a molded construction form during the form's manufacture. The strips of the solid galvanized steel extend to the outer surfaces of the form and provide attachment surfaces whereas the central portion of expanded steel web reinforces the form. The result is a molded construction form that is stronger, and one that further provides easily located embedded attachment surfaces for bracing means during the curing of the concrete and for finishing materials. The molded construction form has a number of galvanized steel strips, preferably ten with five on each outer surface, located at the standard building twelve inch centers, to provide surfaces for attaching any type of wall covering such as sheetrock, siding, paneling, lath for stucco, or brick veneer. These attachment strips also define the location of the vertical cavities and concrete posts within the construction form.

Also if relevance to aspects of the present invention is U.S. Pat. No. 4,854,097 to Haener issued Aug. 8, 1989 for INSULATED INTERLOCKING BUILDING BLOCKS concerning a building block having improved insulating characteristics. The block includes two spaced parallel sidewalls formed from concrete or the like. The first sidewall has at least one inwardly extending integral web, having end portions extending parallel to the sidewall. The second sidewall has inwardly extending interlock members which also have end portions extending parallel to the sidewall. When the sidewalls are assembled parallel to each other to form the front and back faces of the building block, the respective end portions overlap in a manner preventing the sidewalls from moving apart along a line perpendicular to the sidewalls. The overlapping end portions are not in contact with each other. At least part of the volume within the block is filled with a highly insulating foam. The foam fills the space between the overlapping end portions and thus provides structural rigidity to the block. The block has outstanding insulating properties since there are no thermal bridges of block structural material from one sidewall to the other. In the event of fire which melts or destroys the foam material, general structural integrity of a wall built from these blocks is assured by the overlapping end portions which prevent separation of the sidewalls.

U.S. Pat. No. 5,390,459 to Mensen issued Feb. 21, 1995 for CONCRETE FORM WALLS concerns a building component comprising first and second high density foam panels each having inner and outer surfaces, top and bottom, and first and second ends. The panels are arranged in spaced parallel relationship with their inner surfaces facing each other, with at least two bridging members extending between and through and molded into the panel members. Each bridging member comprises a pair of elongated end plates oriented in the top to bottom direction of the panels and abutting against the outer surfaces of the panels, and at least one web member extending between and rigidly connected to the end plates, each web member oriented in the top to bottom direction of the panels and having a height substantially less than the height of the panels.

U.S. Pat. No. 5,465,542 to Terry issued Nov. 14, 1995 for INTERBLOCKING CONCRETE FORM MODULES (SIC) concerns interlocking concrete form modules suitable for creating a concrete wall form. The modules have the general shape of a right rectangular parallelepiped with parallel side walls joined by integral webs that define a plurality of parallel elongate cavities. The edges of the side walls include tongues and grooves that allow the modules to be interlocked to form a wall. The ends of the webs are undercut such that cavities between the modules are created when the modules are suitably interlocked. The between-the-module cavities lie orthogonal to the through-the-module cavities. The modules are formed of an insulating material and left in place. Preferably, the tongues along one edge include notches aligned with the webs. In one embodiment, the modules substantially entirely are formed of relatively dense (3–5 lb./ft.$^3$) expanded polystyrene (EPS). The density of the EPS is adequate to hold threaded wall anchors. In an alternate embodiment, the modules are formed of less dense (approximately 1.5 lb./ft.$^3$) EPS and include embedded nonmetallic attachment elements that are sized and positioned such that surfaces of the attachment elements lie co-planar with the outer surfaces of the side walls of the modules. Preferably, the nonmetallic attachment elements span substantially the entire height of the modules to create equi-spaced furring strips that cover substantially the entire height of a wall formed when the modules are suitably assembled.

U.S. Pat. No. 5,456,444 to Wegman issued Oct. 10, 1995 for CONCRETE FORM WALL ASSEMBLIES AND METHODS concerns a wall form assembly in which a pair of form wall assemblies are kept in preselected spaced parallel relationship by means of cross members fitted within end slots and interlocked by means of pins with elongate braces mounted for movement from a low profile position for transport to a high profile operative position in which the width dimension is transverse to the plane of the form wall for maximum resistance to bowing from the hydrostatic forces of wet cement.

U.S. Pat. No. 4,646,496 to Wilnau issued Mar. 3, 1987 for STRUCTURAL WALL AND CONCRETE FORM SYSTEM concerns a combined structural wall and concrete form system, and form bracket apparatus in which a wall frame acts as the side walls of a poured concrete form, while supporting the form in place. A plurality of brackets are transversely attached to the wall frame adjacent the position of the column form to support form ties for locking the remaining form walls in place to complete a concrete column form and structural wall combination. The header of the wall frame portion acts as the bottom wall of a concrete beam form, while the same brackets as used for the column form can be attached along the top portion of the wall frame for locking beam forms and form ties in place to support the side walls of the concrete beam form. A top bracket formed with angle iron and straps supports the top portion of the side walls of the beam form. The form support brackets are elongated flat metal members of predetermined length having a plurality of slots therein for driving nails and having alignment notches positioned therein, along with upright form support end portions having an angled edge for driving form ties in place. The brackets are adapted for supporting the form ties for both the columns and beams when used in connection with the wall frame.

U.S. Pat. No. 4,443,981 to Weiss issued Apr. 24, 1984 for CONCRETE FORM SYSTEM concerns a system for pouring concrete and thereby forming concrete floors, sidewalks and the like, wherein the forms used to retain the concrete in place remain as part of the permanent installation. The system is constructed basically of longitudinal rails, stakes and clips which fit snugly and securely together to form concrete retaining forms.

SUMMARY OF THE INVENTION

The present invention contemplates easily and economically fabricated modular concrete forms that are (i) rapidly and efficiently produced by minor operations, primarily routing, on common type sheet polymeric material, and by simple cutting and bending of sheet metal, with minimal wastage of both polymer and metal, (ii) transported tightly and compactly in pieces, (iii) flexibly assembled upon a building site to form walls of any size and at any scale with good efficiency, and (iv) thereafter used as modular components of a system, and in a method, for the efficient construction of insulated-sidewall fastener-receiving building walls having any reasonably desired thickness.

In particular, in accordance with the present invention, sidewalls of what will ultimately become a concrete form are made by cutting and relieving, normally by process of routing, a very minor amount of material from a large sheet of readily available sheet-type polymeric material, preferably polyurethane or expanded polystyrene foam. The simple, nearly waste free, fabrication produces planar members (i) that have tongue and groove interlocking features, and (ii) that are substantially rectangular in shape, and generally quite large, typically measuring eight feet by two inches (8'×2") by ten, sixteen or twenty-four inches (10", 16" or 24").

The remainder of what will ultimately become the concrete form consists of metal connecting members of various dimensions. These connecting members ultimately serve to connect the sidewalls, and hold them in a spaced-parallel relationship so as to make a hollow from into which concrete may be poured. In each of several preferred embodiments these metal connecting members are made entirely from common types of sheet and/or low gauge structural wire, typically steel and more typically galvanized steel sheet and structural wire. The metal connecting members are normally made in easy cutting and bending steps having no, or minimal, wastage of material.

The planar rectangular sidewalls are transported to the building site in regular, tight-packed, geometric stacks. The much less voluminous metal connecting members are also easily transported, normally in small cardboard boxes of the like.

At the building site the relatively large sidewalls are quickly assembled in a spaced-parallel arrangement by use of the connecting members, and stacked one atop the next, to produce large concrete wall forms. These wall forms are both precisely sized and precision aligned by virtue of (i) the accuracy of the manufacture of their constituent components (which are of relatively simple geometries) and (ii) the features, normally tongue and groove, of their stacked interconnection.

The wall forms define a cavity into which reinforcing steel rod (re-bar), electrical or communications conduit, plumbing, and all matter of elongate bodies having diverse volumes may permissively be entered. The form cavity is then filled with a flowing construction material, normally concrete.

When the concrete hardens into a wall then the sidewalls of the form become insulating surfaces to the wall. Moreover, elongate portions of the connecting members, which are typically made of metal, appear prominently on the wall's surfaces at exact regular intervals. Fasteners, normally drywall or sheet metal screws, may easily, reliably and strongly attached to the exposed elongate portions of the connecting members, and thus to the wall. The attachments are flush. Further sheet building materials, such as wallboard or paneling, may thus be easily and strongly mounted to the concrete wall.

Still further refinements, and niceties, are possible. An underlayment, normally an apertured strip of sheet metal, may be laid upon the exterior face(s) of the wall in position under, and secured by, the connecting pieces (which go through the wall). This underlaid strip greatly extends the area to which mechanical connection(s) by screws and the like may reliably be made.

Furthermore, the typically metal connecting members are, for reasons of adjustable extension explained below, typically made from multiple pieces. They are thus less effective as a conduit to transmit heat (or cold) through the wall than would be a unitary connecting piece. Nonetheless, the connecting pieces will conduct some thermal energy, and if in further contact with an underlaid metal strip at either surface of the wall, the connecting pieces can undesirably serve to transmit heat through the wall. Accordingly, the connecting pieces can alternatively be made of plastic, or some less thermally conducting material than metal. Moreover, and furthermore, the surfaces of the connecting pieces as are aligned and exposed at the exteriors of the wall, may, especially at that side of the wall interior to a building, be faced with an insulating material. Normally a simple strip of insulating material, typically made from plastic, covers the butt end portions of many connecting pieces as are linearly arrayed upon the surface of a finished wall.

Notably to the present invention, the thickness of the wall so created is a function of the separation between the sidewalls of the wall form, and this separation was defined by the lineal dimensions of the metal connecting members during site assembly of the form. In accordance with the present invention, the metal connecting members, or at least parts thereof, come in different lengths, and walls of any desired predetermined thickness may readily be constructed!

Accordingly, in one embodiment of the present invention a first sidewall member—generally made of polymeric material and preferably of polyurethane or expanded polystyrene foam, normally substantially planar and rectangular in shape, and generally quite large with a typically size ranging to eight feet by two feet by two inches (8'×2'×2")—is disposed in combination with another, identical second, sidewall member to define a cavity therebetween that is suitable to receive a flowed construction material, normally concrete. Each sidewall member has and defines an array of small, slit, apertures that are disposed oppositely to a like array of apertures on an oppositely situated sidewall. The apertures will serve to receive first and second portions of a multi-piece connector, next discussed.

A multi-piece connector extends transversely between, and is partially embedded within, the first and the second sidewall members. This multi-piece connector includes at least three portions. A first connector portion is placed through a slit aperture in a first sidewall member so as to extend from a position flush with an exterior surface of the first sidewall member—which exterior surface may be, however, slightly regionally locally recessed—though the thickness of the polymeric material of the same first sidewall member—which thickness is normally about two inches (2")—to a position slightly beyond the interior surface of the same first sidewall member. The first connector portion typically extends about one inch (1") beyond the interior surface of the first sidewall member, and into what will become the cavity—thus making that the first connector portion is typically about three inches (3") long.

A second connector portion likewise extends from an exterior surface of the second sidewall member which is opposite to the cavity, through a slit aperture and through the substantial thickness of the polymeric material of the same second sidewall member, and to a position that is slightly beyond the interior surface of the same second sidewall member. This second connector portion is normally identical to the first connector portion, and it normally extends into the cavity between the first and the second sidewall members identically as far as does the first connector portion.

A third connector portion spans between the first connector portion and the second connector portion, joining and connecting them so as to make the multi-piece connector. The multi-piece connector so made serves to hold the first sidewall member and the second sidewall member at a predetermined separation, defining a cavity between these two sidewall members. Accordingly, when the poured construction material is used to fill the cavity, a wall is created. Including its two sidewalls, the wall has the substantial thickness of the multi-piece connector member in the combined lengths of its first, its second and its third portions.

Notably, the third connector portion of the multi-piece connector (in particular, but not exclusively) may be of any desired length, making that the thickness of the wall is variably predetermined at a time immediately before the wall is poured.

One preferred embodiment of the first and second connector portions has an integral flange, or more preferably, two oppositely directed flanges. These flanges are located (i) at the sidewalls at their surfaces that are exterior to the cavity, and (ii) in a plane that is orthogonal to the plane of the slit aperture. They prevent that a first or second connector portion should, when inserted in a corresponding slit aperture, be pulled though the slit aperture from the exterior to the interior surface of the sidewall member.

The flanges are suitable to receive and to support and to make a fixed mechanical attachment to fasteners, normally dry wall screws, that engage the flanges from the exterior of the sidewall members. Accordingly, the constructed wall is usable with fasteners—normally screws—that are suitable to attach things, normally paneling or sheet rock or whatever, to the wall.

Elongate apertured strips, normally of metal, may be placed under the preferred flanges of the first, and normally also the second, portions of the multi-piece connector, and between the connector portions and the sidewalls, during assembly. The first and second connector portions fit through regularly evenly spaced arrayed apertures in the strips just as they do through the matching slit apertures of the sidewall members. The strips will ultimately permit the affixation of still other fasteners, commonly screws, to the finished wall. However, during assembly of the form, it should be noted that the elongate apertured strips add mechanical strength, and rigidity, and precision, at the points where the first and second connector portions penetrate each sidewall member.

Finally, in the one preferred embodiment of the third connector portions, it also has an integral flange, or more preferably, an oppositely directed integral flange at each of its two ends. When the form is assembled, these end flanges are located (i) at each sidewall at its surface that is interior to the cavity, and (ii) in a plane that is orthogonal to the plane of the slit aperture. These end flanges help stabilize the sidewalls, and particularly prevent that the third connector portion should extend into a slit aperture of a sidewall member.

Yet another embodiment of the multi-piece connector uses a bent wire as its third portion. The connection of this wire to the first and to the second connector portions is again in a manner that precludes that the third connector portion should be pulled into the slit apertures of the sidewalls or, as an equivalent expression, that the sidewalls should ride up onto the third connector portion.

Regardless of whether bent wire or sheet metal is used to form the third connector portion, this portion may optionally have a typically small and shallow indentation or groove centrally located in its uppermost surface. This indentation receives and helps to centrally position within the form any re-bar reinforcement that may optionally be laid longitudinally within the form, and from form to form, prior to pouring liquid concrete to make the wall.

The effect of all these preferred flanges and linkages is simple: the sidewalls are held in fixed relationship to the multi-piece connector, and the multi-piece connector in fixed relationship to the sidewalls. This relationship is precise, stable, and sufficiently strong so that liquid concrete may be poured into the cavities of forms stacked several courses high without deformation or distortion of the forms, or of the produced wall.

Notably, any of the first, the second, and the third connector portions—and normally all three connector portions—of the multi-piece connector are assembled to the polymeric material sidewalls on the construction site, and before the wall is poured. The modular component construction system of the present invention is thus typically shipped as 1) tight-packed regular-shaped molded-foam panels, accompanied by 2) boxes of metal connector pieces. Shipping is economical. Assembly is also economical due to the typically considerable size of the forms created.

The present invention may alternatively be considered to be embodied in a building system that serves as both (i) a form for a wall made of poured construction material, and (ii) a permanent surface to the wall once poured. In such a characterization of the invention as a combination wall-forming and wall-surfacing system, the preferred embodiment includes two substantially planar, spaced-parallel, construction panels. Each panel is typically of a rectangular configuration. Each panel has and defines edges of a relatively longer length aligned horizontally, and edges of a relatively shorter length aligned vertically. A respective inner surface of each panel is directionally disposed to face a corresponding inner surface of another, spaced-parallel, panel. A planar outer surface of each panel is thus directionally disposed away from the other, spaced-parallel, panel. Finally, each panel has and presents a plurality of vertically-extending slots, normally at regular spaced intervals.

A multiplicity of first metal pieces are each sized and adapted so as to fit though a one of the plurality of slots of each of the two panels so as to extend from the panel's outer surface to its inner surface. Each of these first metal pieces has and defines a flange that is located at the exterior surface of a panel when the metal piece is inserted within a vertical slot of the panel. This flange extends substantially parallel to the exterior surface of the panel and transverse to the panel's slot. It acts both (i) to preclude that the metal piece should be possible of being pulled through the panel from its exterior to its interior surface, and (ii) to present a metal surface that is suitable to attach and to retain a fastener. Accordingly, this flange is reasonably important to the ultimate wall.

Each of the first metal pieces still further has and presents an engagement feature located at the interior surface of the panel when the first metal piece is inserted within a vertical slot of the panel. This engagement feature is suitably sized and configured both so as to (i) be passed through the slot of the panel and, when it is so inserted into a slot, (ii) extend beyond the interior surface of the panel.

Each of a number of second metal pieces is sized and adapted so as to engage the two oppositely-disposed engagement features of two first metal pieces, particularly as these first metal pieces are respectively inserted into two directly-oppositely-disposed and -opposed slots of two panels.

Each of the plurality of second metal pieces has and defines (i) two ends, (ii) a predetermined lineal extent between its two ends—a measure of which extent will determine how far apart the first and the second panel are spaced-parallel—and (iii) an engagement feature, complimentary to the engagement feature of each of the first pieces, at each end. Each of these end engagement features is suitably sized and configured so as to engage, to retain, and to connect the engagement feature of a first metal piece (as has been inserted through a panel's slot and as extends beyond the panel's interior surface).

Each of the plurality of second metal pieces may optionally have and define a flange at either, or preferably both, of its ends. These end flanges are located at an interior surface of a panel when the second metal piece spans between, and connects, two first metal pieces each of which is lodged within a slot of a respective panel. This flange extends substantially parallel to the interior surface of the panel, and transverse to the panel's slot. It acts both (i) to preclude that the second metal piece should be possible of being pulled through the panel from its interior to its exterior surface, and (ii) to stabilize all metal pieces to the panel, and vice versa. Accordingly, this optional flange is reasonably useful in holding things in good and proper position and alignment during construction of the wall.

According to this construction, when the two panels are held spaced parallel by the multiplicity of first metal pieces as extend through the plurality of slots of each panel, and also by the plurality of second metal pieces as engage, span between, retain and connect the first metal pieces, then a cavity is created between the two panels. Poured construction material may be poured into this cavity so as to make a wall.

The poured construction material will capture in its matrix all parts of the first metal pieces that are not within the slots of the panels, and the entirety of the second metal pieces. The poured construction material will create a wall having the substantial thickness of combined lineal extent of the two first metal pieces and the one second metal piece. The wall will have and present the two panels as permanent facing upon each of its two exterior sides.

Notably, and regardless of the suitability of the material of the material of the panels to engage and to retain any fastener, at least the flange of each first metal piece—which flange is located at the exterior surface of a panel when the metal piece is properly inserted within a vertical slot of a panel—is suitable to attach and to retain a fastener. Further area in which to attach fasteners may be created by the simple expedient of lodging apertured sheet material, normally in the form of an elongate apertured strip, between the flanges of the first metal pieces and the exterior surface of the panels. This apertured sheet material, or elongate apertured strip, will be strongly fixedly held to the completed wall, and will become an integral part of the completed wall to which further fasteners may be attached.

Still further in accordance with the present invention, the elongate apertured sheet metal strip may optionally be faced with any equally long coextensive strip of, typically, colored plastic. The plastic strip may be applied to the elongate apertured sheet metal strip before any such fasteners, normally screws, as are used to hold facing material—normally gypsum board and plywood paneling and the like—to the wall, are driven. In this case the color of the plastic strip makes location of the underlying elongate apertured metal strip very easy and convenient. More importantly, the facing strip serves as a thermal insulator.

However, the optional plastic strip may alternatively be applied by gluing, in which case neither it nor the underlying elongate apertured metal strip need subsequently receive any, or any appreciable number of, fasteners or screws. In this case the "naked" exterior surface of the form panels, and the optionally-fitted plastic strips, together form an exposed surface of the wall. This surface is fairly satisfactory for an interior wall, or even for an exterior wall in benevolent climates—especially if the form panels are made from fiberglass and the plastic strips are of commensurate strength and durability. Clearly no "hardware" shows on this "naked" wall surface, which may be substantially flush. The surface of the wall form left exposed may even be considered reasonably decorative, presenting an interesting, textured, surface with regularly spaced vertical stripes (from the plastic strips) which stripes may optionally be of any number of same or contrasting colors.

These and other aspects and attributes of the present invention will become increasingly clear upon reference to the following drawings and accompanying specification.

BRIEF DESCRIPTION OF THE DRAWINGS

FIG. 1 is a diagrammatic perspective view showing a number of first preferred embodiment of a concrete form in accordance with the present invention assembled at a building site so as to form a partial wall form, the partially assembled wall form partially defining a door opening.

FIG. 2 is a side plan view,

FIG. 3 is a top plan view, and

FIG. 4 is an end plan view of a preferred embodiment of a sidewall, part of the first preferred embodiment of a concrete form in accordance with the present invention previously seen in FIG. 1.

DESCRIPTION OF THE PREFERRED EMBODIMENT

Figure 5:
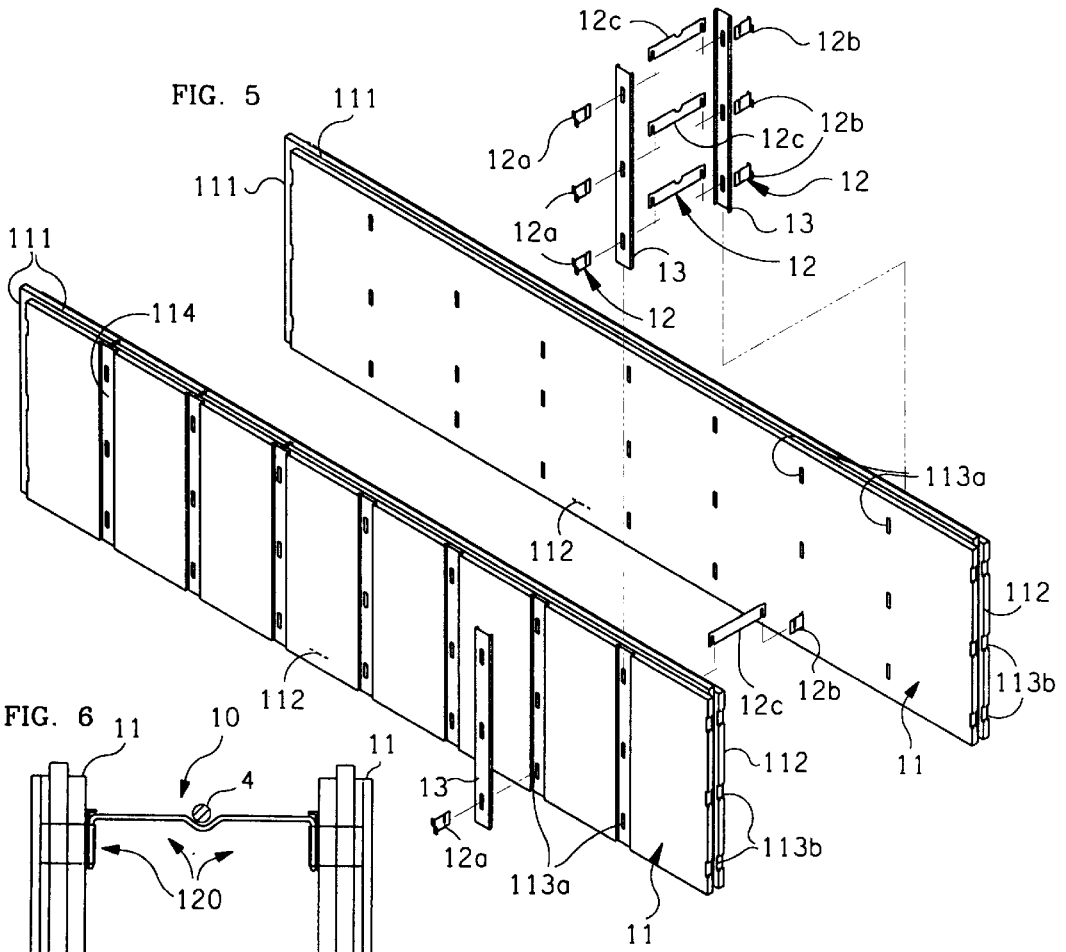
FIG. 5 is a exploded diagrammatic view of the assembly of two sidewalls, previously seen in FIG. 2, with a first embodiment of a multi-piece connector in order to make the first preferred embodiment of a concrete form in accordance with the present invention previously seen in FIG. 1.

The manner of assembling individual construction forms in accordance with the present invention to produce a wall form for a concrete wall is illustrated in FIG. 1. In FIG. 1 a number of construction forms 1 are shown positionally stacked and arrayed, one atop the other in alignment, so as to form a wall of (i) any reasonably desired height, (ii) any reasonable thickness, and (iii) any reasonable straight or broken-line contour, all as is supported by the individual forms. The general principles of constructing a wall form from modular individual forms is taught in U.S. Pat. No. 4,223,501 for a CONCRETE FORM to DeLozier, and also in U.S. Pat. No. 4,879,855 for an ATTACHMENT AND REINFORCEMENT MEMBER FOR MOLDED CONSTRUCTION FORMS to Berrenberg.

It is generally possible to do anything with the forms 1 of present invention that it is possible to do with the previous concrete forms of DeLozier and/or Berrenberg. Namely, openings in a building's wall such as windows (not shown), or a doorway 2, may be accommodated. Connecting walls (not shown) that are perpendicular, or even angled, relative to a given wall may be created.

All the several walls, typically at least four such walls, of at least one story of a building are normally formed from appropriately stacked and arrayed concrete forms 1 all at the same time. The typically contiguous cavity of the composite wall form is then filled, typically all in a continuous operation, with a poured construction material, typically concrete or cement.

Although it is neither difficult nor impractical to form and/or pour a wall in sections, the forms 1 become a part of the completed wall, and are not reused. Accordingly, there is little reason not to assemble many individual forms 1 together, and all at one time, so as to be filled with the poured construction material in a continuous, or nearly continuous, pour. This process ultimately produces a wall having a concrete interior (not shown) that is a unitary continuum of maximum strength, and without appreciable pour lines or boundaries.

In accordance with the present invention, each individual one of the forms 1 is assembled on and at the site where a building or other structure will be erected. Each form 1 may be so assembled from its constituent parts (as will be discussed) right on the ground, or right upon top of a lower form 1 or a course of forms 1. Alternatively, a form 1 may be assembled on a work site work table, or other convenient location. Each assembled form 1 is then placed in position relative to other forms 1 in order to contribute to the overall wall form. Because assembly of the wall forms 1—as will be more precisely illustrated in FIG. 5—is fast and easy, it does not much matter which alternative is adopted. Normally at least the lower courses of the wall forms 1 are assembled in situ while preassembled forms 1 are simply lifted onto and fitted to higher courses of the wall that are above the convenient access height of a workman. In certain larger construction jobs, one individual or team may assemble forms 1 while another individual or team stacks and arrays such forms as the wall form of a complete building.

Continuing in FIG. 1, each of the forms 1 includes two sidewalls 11 that are held in a spaced parallel relationship by several, normally sixteen to twenty-four (16–24), multi-piece connectors 12. The multi-piece connectors 12 may be viewed both to the interior of sidewalls 11 (when such sidewalls 11 are assembled into a form 1), and, in a small portion 12*a*, to the exterior of each such sidewall 11. Those small portions 12*a* of the multi-piece connectors 12 that appear to the exterior surface of the sidewalls 11 are regularly spaced and arrayed.

A more extensive feature than are the small portions 12*a* of the multi-piece connectors 12 is also visible on the exterior surface of the sidewalls 11, and of the forms 1. This feature is in the substantial appearance of a vertical band, or strip, 13 when the forms 1 are typically stacked and arrayed with their elongate axis horizontal. This band, or strip, 13 is typically made from sheet metal, typically by a shearing process. The band, or strip, 13 has arrayed apertures in the form of elongate slots (i) spaced equidistantly along its length, (ii) aligned with the long axis of the band, and (iii) centered in the band. These apertures are typically formed in and by a punch press.

The presence of the strip 13 is optional, but preferred. It fits under the exterior portions 12*a* of several multi-piece connectors 12, and between these portions 12*a* and the exterior surface of the sidewall 11. The strip 13 is held to the exterior surface of the sidewall 11 by the exterior portions 12*a* of several multi-piece connectors 12 (in a manner to be explained), and will itself suffice to hold fasteners, normally metal screws, that are set into the strip typically at some time after fabrication of the wall from the arrayed wall forms.

The band, or strip, 13 is normally only so long as each form 1 is high (and is so illustrated in FIG. 5). However, rarely, a single metal band, or strip, 13 (modified) may extend across the sidewalls 11 of several forms 1, connecting to and under plural, normally two or 3 (2–3), exposed portions 12*a* of several multi-piece connectors 12 at each form 1 (not shown in FIG. 1). Such a multi-form span, and such a connection, of an extended strip 13 (modified) obviously adds some physical strength, and promotes alignment, between the forms 1 that are upon successive courses at a time before the forms are filled with concrete.

Of course, to the extent that an optionally extended metal band, or strip, 13 (modified) spans multiple forms 1, then each such form 1 is no longer assembled in isolation, and must be assembled in position (on a wall, or whatever) relative to any and all other forms 1 to which it is connected. Moreover, if walls constructed from the forms 1 are, as is desired, to always be an arbitrary number of courses, and forms 1, in height, then any strips 13 (modified) that span more than the height of one form 1 may have to be provided in different lengths. There are so few parts to the wall forms 1 of the present invention that this is not especially objectionable, and some projects and construction workers may prefer the longer length of strips 13 (modified).

Although, as previously stated, a metal band, or strip, 13 having only the height of single sidewall 11, and form 1, is preferred of incorporation into the form 1, there is at least one beneficial use of a longer metal band, or strip, 13 (modified) that spans the "height" of several sidewalls 11, and forms 1. This use is in the rare case that the long axis of the sidewalls 11, and of the forms 1, is aligned vertically (not shown in FIG. 1). Although it is obvious that the horizontally-arrayed forms 1 shown in FIG. 1 rest stably atop each other during assembly under force of gravity, if two or more forms 1 are stacked side by side with the elongate axis of each vertical—such as in construction of a tall, thin, tower or the like—then the positional stability of the forms 1 is much less certain, resting as they do then upon but their short sides. Although the affixation of a planar side covering panel, or covering sheet to the open vertical sides of such vertically-arrayed forms 1, and/or the wrapping of several such forms in sheet plastic, in order to keep any concrete that is poured into such vertically-arrayed forms from oozing out the elongate sides of the forms will not be gone into in detail here, it should be understood that the forms 1 can exceedingly rarely, and for a typically limited number and extent of such forms, be vertically arrayed, such as in the constructing a tall, narrow wall (e.g., for a tower, or the like). In this special application, particularly, a metal band, or strip, 13 (modified) preferably spans the "height" of several sidewalls 11, and forms 1. So spanning, the strip 13 (modified) helps hold these forms 1 tightly arrayed and positioned together during construction of a wall in a manner that is generally entirely unnecessary during the normal construction of a normal wall with and from horizontally-arrayed forms 1 as are shown in FIG. 1.

The minor exposed portions 12*a* of the multi-piece connectors 12 are substantially flush with the external surfaces of the forms 1, and the external surface of the wall which such forms 1 serve to create. These exposed portions 12*a* of the multi-piece connectors 12 are of sheet metal, preferably sheet steel and more preferably galvanized steel sheet. They are suitable to receive and to engage fasteners, particularly sheet metal screws. However, their area, without the accompanying strip 12, is small. The regular array of the exposed portions 12*a* on the surface of the wall—as is particularly visible in FIG. 1—serves to facilitate location of these attachment points by a workman for purposes of attaching sheet rock, siding, paneling, lath for stucco, brick veneer, or like surfacing material to the wall which is formed both with and from the construction forms 1.

As illustrated in FIG. 1, the construction forms 1 may be clearly be adapted and used compatibly with other construction elements such as, for example, a beam 2 and a lintel 3. The lowest course of the construction forms 1 normally rest upon a foundation, normally a poured foundation wall (not shown). Any foundation bolts or other anchoring mechanisms (not shown) that protrude from this foundation and into the cavities of one or more courses of construction forms 1 will ultimately become embedded in the wall formed from, and with, the construction forms 1. Still other items—particularly including but not limited to re-bar, electrical wiring, communications wiring, optical cable, plumbing, gas and vacuum lines (all not shown)—may be placed within the cavities of the stacked and arrayed construction forms 1 so as to ultimately become embedded in the wall that is formed from, and with, the construction forms 1.

A side plan view, a top plan view, and an end plan view of a preferred embodiment of the sidewall 11, part of the first preferred embodiment of a concrete form 1 in accordance with the present invention (previously seen in FIG. 1) are respectively shown in FIGS. 2–4. The dimensions A–K are typically as follows; A: 8', B: 10" or 16" or 24", C: 2¼", D: ¾", E: ¾", F: ¾", G: 5" or 10" or 8"; H: 2", I: 0.625", J: 0.625", K: 0.625", L: 12"; M: 2", and N: 0.625".

Described in language, the sidewall, or panel, 11 is substantially planar and rectangular in shape, and generally quite large, typically measuring eight feet in length by two inches in width (8' l×2" w) by ten, sixteen or twenty-four inches in height (10" h, 16" h or 24" h). It contains minor apertures and contours. Namely, a tongue 111 or a groove 112 is present on all edges. Namely, the sidewall 11 has and presents arrayed full apertures 113*a*—normally 3×7 or 21 such full apertures 113*a* for a sidewall of 24" height (B=24") as illustrated, or else 2×7=14 such full apertures 113*a* for sidewalls of 10" and 16" heights (B=10", or 16")—and partial, or split, end apertures, 113*b*. Namely, the sidewall 11 further has and presents partial end apertures 113*b*—normally 2×3 or 6 such partial end apertures 113*b* for a sidewall of 24" height (B=24") as illustrated, or else 2×2=4 such partial end apertures 113*b* for sidewalls of 10" and 16" heights (B=10", or 16"). Finally, parallel elongate shallow channels 114 are present on a one major side of the sidewall 11.

All these features are preferably made be simple cutting and relieving operations, normally by process of drilling and routing. Only a very minor amount of material is removed. Each sidewall, or panel, 11 is typically cut from a large sheet of readily available sheet-type polymeric material, preferably polyurethane or expanded polystyrene foam. The simple, nearly waste free, fabrication produces sidewalls, or panels, 11 that have (i) tongue 111 and groove 112 interlocking features, (ii) apertures 113*a*, 113*b*, in a precise gird pattern, and (iii) parallel elongate shallow channels 114.

An exploded diagrammatic view of the assembly of two sidewalls 11, previously seen in FIG. 2, along with a first embodiment of a multi-piece connector 12 in order to make the first preferred embodiment of a concrete form 1 in accordance with the present invention (previously seen in FIG. 1) is shown in FIG. 5. A detail exploded view of a first embodiment of the multi-piece connector 12—useful to understanding the assembly process—is shown in FIG. 8.

Referring first to FIG. 5, and considering first the sidewalls 11, the tongues 111 along one major and one minor edge of each panel 11 may be observed to be directionally disposed in the same directions for each sidewall 11. Likewise, the grooves 112 along each of the other, remaining, major and the other, remaining, minor edge of each sidewall 11 are also directionally disposed in the same directions. These tongue and groove features 111, 112 clearly do not serve to interlock the two sidewalls 11 of the single form 1 shown in FIG. 5. They are rather, of course, involved in the stacking of successive courses of the forms 1 as is most clearly shown in FIG. 1.

The parallel elongate shallow channels 114 in each of the two sidewalls 11 are disposed to the exterior of each sidewall 11, and of the assembled form 1. Each of the channels 114 may optionally be fitted and filled with an elongate apertured metal band, or strip, 13—of which one such strip 13 is shown in FIG. 5 as exemplary. If so fitted then a first portion of 12*a* a multi-piece connector 12 will pass in part through a positionally corresponding slot within the strip 13, and further though a corresponding aperture 113*a*, 113*b* in a sidewall 11.

Figure 8:
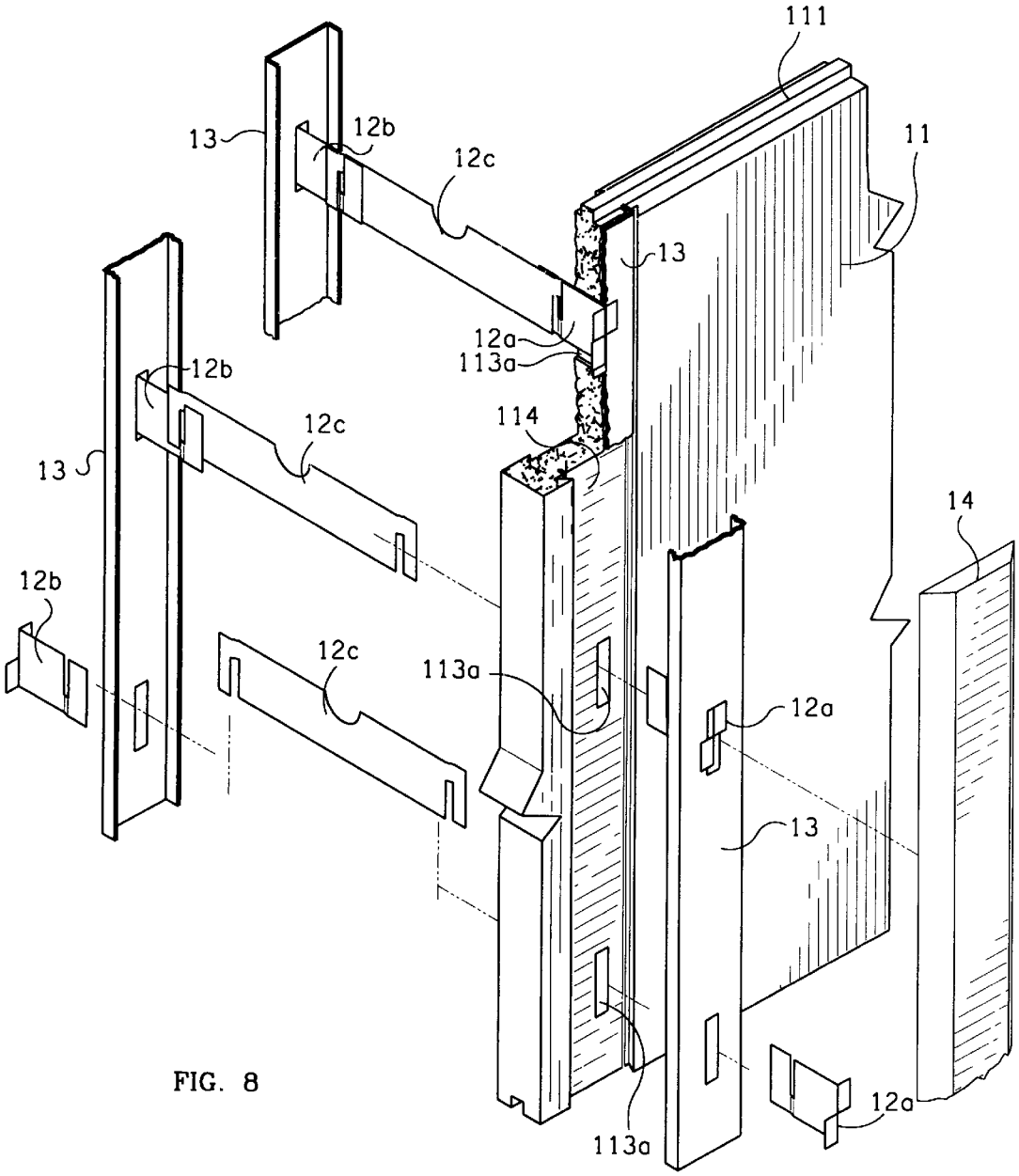
FIG. 8 is an detail exploded view of the first embodiment of the multi-piece connector previously seen in FIG. 6, now shown in conjunction with a cut-away partial representation of one form sidewall, previously seen in FIGS. 2–4, to which, and within which, the first embodiment of the multi-piece connector becomes affixed.

A first embodiment of multi-piece connector 12 extending transversely between, and partially embedded within, the first and the second sidewalls 11 is shown in both FIGS. 5 and 8. This first embodiment of the multi-piece connector 12 includes at least three portions 12*a*, 12*b*, 12*c*. Of these portions, first portion 12*a* and second portion 12*b* are identical. However, there is sufficient geometry involved in understanding how all forces in the form 1 are taken up in the multi-piece connector 12—both during assembly and during pouring of concrete—that it is useful to label portions 12*a* and 12*b* separately in this specification.

A first connector portion 12*a* is placed through a slit aperture 113*a*, 113*b* in a first sidewall 11 so as to extend from a position substantially flush with the exterior surface of the first sidewall 11—which exterior surface may be, however, slightly regionally locally recessed in accordance with channel 114 (shown in FIG. 3)—though the thickness of the polymeric material of the same first sidewall 11—which thickness is normally about two inches (2")—to a position slightly beyond the interior surface of the same first sidewall 11. If a strip 13 is present, the first connector portion 12*a* is placed through a slit in this strip 13 prior to being placed through the slit aperture 113*a*, 113*b*—as is best illustrated in FIG. 8. The first connector portion 12*a* is susceptible of being inserted though the slits in only one direction—again as is best seen in FIG. 8. The double edge slits 12*a*1, 12*a*2 (to be further discussed later) in the first connector portion 12*a*—best seen in FIG. 8—are disposed to open in the upward direction.

An identical second connector portion 12*b* is likewise placed through a slit aperture 113*a*, 113*b* in the other sidewall 11 so as to extend from a position substantially flush with the exterior surface of this second sidewall 11—which exterior surface may again be regionally locally recessed by presence of channel 114 (shown in FIG. 3)—though the thickness of the polymeric material of the same second sidewall 11 to a position slightly beyond the interior surface of the same first sidewall 11. If a strip 13 is present at this sidewall 11, then the second connector portion 12*b* is again placed through a slit in this strip 13 prior to being placed through the slit aperture 113*a*, 113*b*. The first connector portion 12*b* is again inserted though the slits in only one direction—as is best seen in FIG. 8. The double edge slits 12*b*1, 12*b*2 (discussed further later) in this second connector portion 12*b* are also disposed to open in the upward direction—as is best seen in FIG. 8.

Each of the first and the second connector portions 12*a*, 12*b* typically extend about one inch (1") beyond the interior surface of the corresponding sidewall 11, and into what will become the cavity of the form 1—thus making that the each of the first and the second connector portions 12*a*, 12*b* is typically about three inches (3") long.

A third portion 12*c* of multi-piece connector 12 spans between the first connector portion 12*a* and the second connector portion 12*b*, joining and connecting them so as to make the multi-piece connector 12. Each of the first connector portion 12*a* and the second connector portion 12*c* have (i) tabs (discussed later) at a one end, and (i) double edge slits 12*a*1, 12*a*2; 12*b*1, 12*b*2, bounding a recessed region at the other end. The third connector portion 12*c* has complimentary double slits 12*c*1–12*c*4 at each end region, each pair of slits 12*c*1, 12*c*2 and 12*c*3, 12*c*4 defining and bounding a complimentary recessed region to the recessed region that is within both first and second connector portions 12*a*, 12*b*. The third connector portion 12*c* also preferably terminates at each end with a single flange 12*c*5, 12*c*6—each of which flanges 12*c*5, 12*c*6 extends from orthogonally from the major plane of the third connector portion 12*c* in an opposite direction.

The edge slits 12*a*1, 12*a*2 and the recessed region of the first connector portion 12*a* engage the complimentary edge slits 12*c*1, 12*c*2 and the recessed portion of a one end of the third connector portion 12*c*. The edge slits 12*b*1, 12*b*2 and recessed region of the second connector portion 12*b* likewise engage the complimentary edge slits 12*c*3, 12*c*4, and the recessed portion, of the other end of the third connector portion 12*c*. All three portions 12*a*–12*c* of the multi-piece connector 12 fit together readily by hand. However, because of the interlocking design of the slits and the contours of the three connector portions 12*a*–12*c*, the multi-piece connector 12 is quite tight, snug and rigid. It is not subject to movement or deformation even during the pouring of concrete into the cavity of the form 1.

The multi-piece connector 12 so made and so connected serves to hold the sidewalls 11 at a predetermined separation, defining a cavity between these two sidewalls 11. Accordingly, when the poured construction material is used to fill the cavity, a wall is created. Including its two sidewalls, the wall has the substantial thickness of the multi-piece connector 12 in the combined lengths of its first portion 12*a*, its second portion 12*b*, and its third portion 12*c*.

Although all portions 12*a*–12*c* of the multi-piece connector 12 may be of any desired length, the third portion 12*c* of the multi-piece connector 12 in particular (but not exclusively) may be of any arbitrary length (within reason, as dictated by its function). Accordingly, the multi-piece connector 12 determines the thickness of the wall that is produced with and by the form 1. This determination is at the construction site and at a time immediately before the wall is poured.

Returning to a detail explanation of the preferred first embodiment of the multi-piece connector 12 as is shown in FIGS. 5 and 8, this multi-piece connector 12 has an integral flange, or more preferably, two oppositely directed integral flanges 12*a*3, 12*a*4; 12*b*3, 12*b*4 at a one end of each of its first portion 12*a* and its second portion 12*b*. These flanges 12*a*3, 12*a*4; 12*b*3, 12*b*4 are located at the surfaces of the sidewalls 11 that are exterior to the cavity, and (ii) in a plane that is orthogonal to the plane of the slit apertures 113*a*. These flanges 12*a*3, 12*a*4; 12*b*3, 12*b*4 respectively prevent that the corresponding connector portions 12*a*, 12*b* should, when inserted in a corresponding slit aperture 113*a*, 113*b*, be pulled though the slit aperture 1131, 113*b* in a direction from the exterior to the interior surface of the sidewalls 11.

Notably, the flanges 12*a*3, 12*a*4; 12*b*3, 12*b*4 are themselves, and without more, suitable to receive and to support and to make a fixed mechanical attachment to fasteners, normally dry wall screws, that engage the flanges 12*a*3, 12*a*4; 12*b*3, 12*b*4 at their exposed positions on the exterior of the sidewalls 11. Accordingly, the constructed wall is usable with fasteners—normally screws (not shown)—that are suitable to attach things, normally paneling or sheet rock or whatever, to the wall.

However, it may now be appreciated that the elongate apertured metal strips 13 that may optionally be placed under the preferred flanges 12*a*3, 12*a*4; 12*b*3, 12*b*4 of the connector portions 12*a*, 12*b*, and between these connector portions and the sidewalls 11, during assembly will also serve to receive and retain fasteners, namely screws. Since it may be difficult when installing large sheets of gypsum board, or plywood panels, to the finished wall for a workman to locate the exact positions of all the arrayed flanges 12*a*3, 12*a*4; 12*b*3, 12*b*4 (as are at the exposed regions of the arrayed connector portions 12*a*, 12*c*) in order to drive screws, the presence of the contiguous vertical attachment region presented by the combined strips 13 of the several stacked and arrayed forms 1 (see FIG. 1) is not only an advantage, but makes both the location of attachment regions (i.e., the strips 13 themselves), and subsequent attachments to these regions, very easy.

Continuing in FIGS. 5 and 8, the purpose of the integral end flanges 12*c*5, 12*c*6 of the third portion 12*c* of the multi-piece connector 12 should be carefully considered, and appreciated. When the form 1 is assembled, these end flanges 12*c*5, 12*c*6 are located at each the interior wall of each of the two sidewalls 11, and in planes that are orthogonal to the planes of the slit apertures 113*a*, 113*b* that are within the sidewalls 11. These end flanges 12*c*5, 12*c*6 help stabilize the sidewalls 11 to the multi-piece connector 12, and the multi-piece connector 12 to the sidewalls 11. They particularly prevent that the third connector portion 12*c* should extend into a slit aperture 113*a*, 113*b* of a sidewall 11. They also prevent that the form 1 should be knocked askew, or catawompous.

The third connector portion 12*c* may optionally present approximately midway along its uppermost edge a typically shallow, typically small, groove, or channel, as illustrated. The grove may be of triangular, rectangular, or semi-circular shape. The groove is suitable for supporting re-bar reinforcing rod that is laid longitudinally within a form 1, and from form to form. The groove may be of complimentary shape and size to re-bar reinforcing rod. It helps during all phases of construction to place, and to maintain in place, the re-bar reinforcing rod in its optimal position which is central to the form 1, and to the wall that is built with the form 1.

In summary of the forms 1 and the preferred assembly method thereof so far, each of the arrayed forms 1 is large, and is subject to substantial deformation and expansion forces when concrete is poured into its interior cavity. Each form 1 is held together with but simple pieces of interlocking metal—called a "multi-piece connector"—and rests upon lower forms only by force of gravity. Yet all forces such as might tend to cause misalignment of an individual form 1, or of the arrayed forms 1, are adequately taken up both upon the assembly and erection of the arrayed forms, and during the pouring of the wall. An individual form 1 cannot but be assembled straight and true by properties of (i) its tongue and groove edge features, and (ii) the multi-piece connector 12.

Forms 1 stacked one atop the other are naturally and innately correctly aligned relative to one another, particularly by assistance of the horizontal ones of the tongues 111 and the grooves 112 (shown in FIGS. 2–4). (The wall will be either vertical or slanted in accordance whether its base is upon a surface, or foundation wall, that is either level or slanted.) Finally, a wall can be made zig-zag, or corners can be turned at the scale of the forms 1. However, if it is desired to simply make a straight wall then this basic construction is natural, and innate, to the self-alignment of the forms 1 relative to one another, particularly as occurs by assistance of the vertical ones of the tongues 111 and the grooves 112 (shown in FIGS. 2–4).

Figure 6:
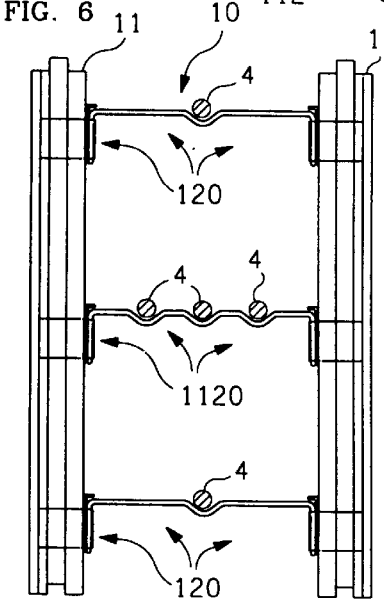
FIG. 6 is an end plan view of a second preferred embodiment of an assembled construction form in accordance with the present invention, the second preferred embodiment of the concrete form using the same sidewall previously seen in FIGS. 2–5 but employing a second embodiment of a multi-piece connector.
Figure 7A:
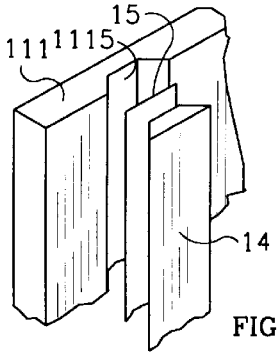
FIG. 7*a* is an exploded view of a second embodiment of the sidewall, previously seen in FIGS. 2–4 and 7 along with a facing strip, the sidewall receiving either embodiment of the multi-piece connector after which the facing piece is affixed.
Figure 7:
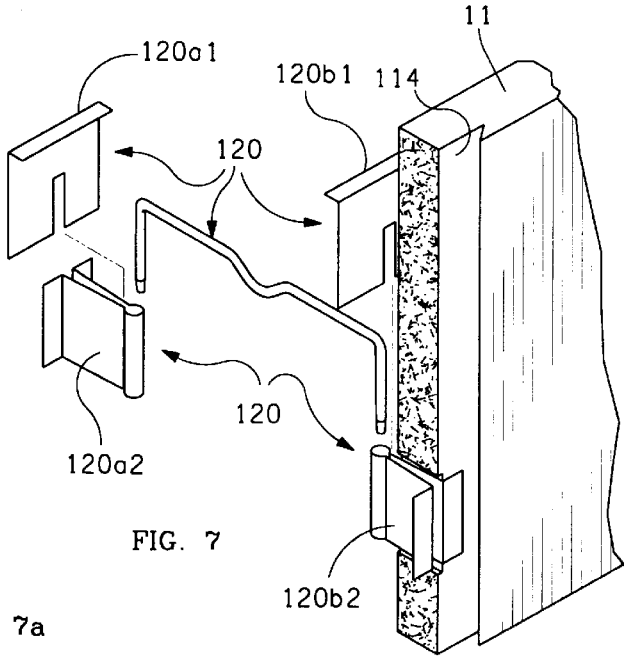
FIG. 7 is an exploded view of the second embodiment of the multi-piece connector previously seen in FIG. 6, now shown in conjunction with a partial representation of a first embodiment of a sidewall, previously seen in FIGS. 2–4, to which, and within which, the second embodiment of the multi-piece connector becomes affixed.

In yet another embodiment a multi-piece connector 120 may be formed as illustrated in FIGS. 6 and 7. As before, the second embodiment of the multi-piece connector 120 becomes affixed to each of two sidewalls 11, and holds these sidewalls in spaced parallel positions to make a construction form 10. The second preferred embodiment of a multi-piece connector 120 is shown in end plan view within an assembled construction form 10 in FIGS. 6. An exploded view of the same second embodiment of the multi-piece connector 120, now shown in conjunction with a partial representation of the same-type sidewall 11 previously seen in FIGS. 2–4, is shown in FIG. 7.

The second embodiment of the multi-piece connector 120 has identical first and second connector portions 120*a* and 120*b* each of which consists of a tab, or clip, section 120*a*1, 120*b*1, and a bent channel piece, or section, 120*a*2, 120*b*2. The bent channel pieces, or sections, 120*a*2, 120*b*2 pass though the slit apertures 113*a*, 113*b* (shown in FIG. 5) in the sidewalls 11. When so inserted, each tab, or clip, section 120*a*1, 120*b*1 clips and affixes in position the corresponding channel pieces, or sections, 120*a*2, 120*b*2. A corresponding sidewall 11 is tightly held between the two parts of each of the first and the second connector portions 120*a*, 120*b*.

The reason that channel pieces, or sections, 120*a*2, 120*b*2 are so called is that they present, as bent and contoured, a channel to the third connector portion 120*c*. This third connector portion 120*c* is in the simple form of a strong, bent wire. The separation between the sidewalls is clearly a function of the length of this bent wire.

The third connector portion 120*c* may also, like the connector portion 12*c*, optionally present approximately midway along its uppermost edge a typically shallow, typically small, groove, or channel, as illustrated. The groove is again suitable for supporting re-bar reinforcing rod that is laid longitudinally within a form 1, and from form to form.

Accordingly, the second embodiment of the multi-piece connector 120 also becomes affixed to each of two sidewalls 11, and holds these sidewalls in spaced parallel positions to make a construction form 10. The connection of the wire portion of this second embodiment of the multi-piece connector to the remaining connector portions is again in a manner that precludes that these portions should be pulled into the slit apertures of the sidewalls or, conversely, that the sidewalls should ride up onto the wire portion of the connector.

The effect of all these preferred flanges and linkages is simple: the sidewalls are held in fixed relationship to the multi-piece connector, and the multi-piece connector in fixed relationship to the sidewalls. This relationship is precise, stable, and sufficiently strong so that liquid concrete may be poured into the cavities of forms stacked several courses high without deformation or distortion of the forms, or of the produced wall.

That portion of either embodiment of the multi-piece connector that extends to the exterior of a sidewall 114 may be covered over with a facing strip. The channel 114 of the sidewall 11 shown in FIGS. 7 and 8 is of a trapezoidal cross-section with the long edge of the trapezoid exposed to the interior of the channel. The facing piece 14 (shown in FIG. 8) that fits within this channel 114 is obviously of complimentary size and shape. The facing piece 14 (shown in FIG. 8) may be slid lengthwise into the complimentary channel 114 of trapezoidal cross-section, or it may alternatively be snapped, or forced under pressure, past the lips of the channel 114 so as to thereafter reside within the channel 114. The suitability of so forcing the facing strip 14 (shown in FIG. 8) into the channel 114 is a function of the deformability, and elasticity, of the materials of both the sidewall 11 and the facing strip 14.

Because it is not always suitable to slide, or to force, the facing strip 14 into a channel 14 that has its greatest width at its base, the same facing strip 14 can be installed the other side round into a sidewall 111 having a channel 1115 that is, as shown in FIG. 7*a*, still of trapezoidal cross-section. However, the channel 115 now has the wide base of the trapezoid to the exterior. An exploded view of this second, alternative, embodiment sidewall 111 is shown in FIG. 7*a*. The facing strip 14 is now preferably affixed by a new element, an adhesive strip or layer 15. The facing strip 14 in either of its orientations may, of course, be affixed to underlying structure, including to the end portions of the multi-piece connectors 12, 120, by conventional fasteners such as screws and nails trip, but a major purpose of the facing strip 14 in either orientation is cosmetic, and an affixation by adhesive 15 servers to preserve the exterior face unblemished.

A detail exploded view of the first embodiment of the multi-piece connector 12 (previously seen in FIG. 6) is shown in conjunction with a cut-away partial representation of one form sidewall 11 (previously seen in FIGS. 2–4) in FIG. 8. The mode and manner of the progressive assembly of the multi-piece connector 12 is shown from bottom to top of the figure. The optional, but preferred, strips 13 are shown in positions underlying each of the first connector portions 12*a* and the second connector portions 12*b*.

A one strip 13 is shown faced with a typically equally long, and coextensive, strip 14 made of, typically, colored plastic. The plastic strip 14 may be applied to the elongate apertured sheet metal strip 13 before any such fasteners (not shown), normally screws, are driven into and through the broad surface of the metal strip 13. Screws (not shown) are so driven in order to hold facing material (not shown)—normally gypsum board and plywood paneling and the like—to the completed wall (shown in FIG. 1). The plastic strip 14 is preferably colored, making location of the underlying elongate apertured metal strip 13 both easy and convenient. The plastic strip 14 serves as a thermal barrier to the conduction of heat through the wall by its multi-piece connector 12, and as a moisture barrier to condensation on the exposed surfaces of the first connector portion 12*a* and the metal strip 13.

The optional plastic strip 14 may alternatively be applied by construction adhesive. In this case neither it nor the underlying elongate apertured metal strip 13 need subsequently receive any, or any appreciable number of, fasteners or screws in order to be held together. However, it should be understood that the plastic strip by itself, only, may be screwed to the underlying metal strip 13. In this case the funnel heads of the typically sheet rock screws set into the plastic of the strip 14, leaving a flush surface.

Both these manners of assembling the plastic strip 14 directly to the underlying metal strip 13 directly, and without more, are used when a "naked" exterior surface of the form panels 11 is to be presented. In this case the optionally-fitted plastic strip 14 forms, together with the panel 11, an exposed surface of the wall. As previously explained in the Summary of the Invention section of this specification, this surface is fairly satisfactory for an interior wall, or even for an exterior wall in benevolent climates—especially if the form panels are made from fiberglass and the plastic strips are of commensurate strength and durability. Clearly no "hardware" shows on this "naked" wall surface, which may be substantially flush. The surface of the wall form 1 left exposed may even be considered reasonably decorative, presenting an interesting, textured, surface with regularly spaced vertical stripes (from the plastic strips) which stripes may optionally be of any number of same or contrasting colors. It should also be understood that this surface may be stuccoed, or painted, or otherwise treated other than by sheathing with still further planar building materials.

Notably, any of the first, the second, and the third connector portions—and normally all three connector portions—of the multi-piece connector are assembled to the polymeric material sidewalls on the construction site, and before the wall is poured. The modular component construction system of the present invention is thus typically shipped as 1) tight-packed regular-shaped molded-foam panels, accompanied by 2) boxes of metal connector pieces. Shipping is economical. Assembly is also economical due to the typically considerable size of the forms created.

The forms of the present invention readily permit the construction of certain walls that are uncommon of association with concrete. In the first place, and as already noted in the BACKGROUND OF THE INVENTION section, laid-up brick walls and architecture do not much look like concrete walls at large scales on the order of tens of meters, the brick walls being generally more convolute. Concrete walls produced by the use of the forms of the present invention may be convolute on the scale of the forms or shorter (if the forms are cut), varying in angle typically on a scale as short eight feet (8'). The forms of the present invention thus permit concrete walls to be constructed with many more corners and angles than heretofore, adding strength as well as beauty.

Next, the interior surfaces of the polymeric sidewalls, and thus the exterior surfaces of the cured concrete, need not be perfectly planar. The can, in fact, show complex curves— generally a parabola or hyperbola. These features, or curves, are placed in the polymeric material of the sidewalls at the factory, generally by routing or, preferably, simply by stamping the polymeric material to a higher degree of compression at the location of, and in the contour of, the desired feature, or curve. These curves are desirably placed in the surface, and in the thickness, of a concrete wall to deflect, and to stop, long cracks. These features can be complimentary to, and interactive with, reinforcing re-bar contained within the wall.

In particular, a concrete wall generally fractures, and cracks, along a substantially vertical or vertically-slanted line (in response to different sagging and/or uplift forces along its length). A hyperbolic curve can help to serve as a "crack stop" by deflecting, and re-directing, such vertically-running cracks. The thicker region of the wall in the location of the hyperbolic curve that sweeps from a generally more vertical to a generally more horizontal direction can serve this purpose. A hyperbolic curve set in the form can, with proper orientation of the form, sweep first in one direction at and within a lower course of forms, and next in the opposite direction at and within a next higher course of forms. The direction of the sweep of the curve is established, of course, simply by the direction at which a form of the present invention so containing such a curve or other pre-existing feature is placed in the wall.

These features are, of course, invisible in the completed wall, which still has a planar exterior surface. The features can, however, have an effect on the strength and durability of the wall, especially in seismically active areas.

A final wall variation of which the forms of the present invention are readily capable of creating is a wall that varies in thickness along its horizontal extent. A single form can, in accordance with a varying length in the connecting members between the form sidewalls, vary in thickness along its typical eight foot (8') length. Overlying curses of forms can be of like, or opposed, variation in thickness. The next form along the length of the wall can be stepped (to the limit of the polymeric material so that the poured concrete does not run out of the arrayed forms), or of a symmetrically opposed orientation. Many interesting, and different, contours of walls can readily be made.

In accordance with the preceding explanation, variations and adaptations of concrete forms in accordance with the present invention will suggest themselves to a practitioner of the architectural and construction arts.

For example, a form having sidewalls of two or more layers is possible, and these forms can be mixed within single building. Consider, for example, construction of a building wherein it is a prior known that a large, multi-story, interior wall is to faced at the buildings interior in wood. If this wood facing may suitably be partitioned at the area of one, or some regular array (e.g., 2×2) of, construction forms, and if this wood facing can be melded with a first connector portion, then the wood facing might be part of the wall as built. The manner in which modular facing materials of different types may be combined with the modular concrete forms of the present invention is facilitated by the large size of the forms, and is the subject of further development by the inventors.

In accordance with these and other possible variations and adaptations of the present invention, the scope of the invention should be determined in accordance with the following claims, only, and not solely in accordance with that embodiment within which the invention has been taught.

What is claimed is:

1. A self-supporting form disposed as a first sidewall member in combination with a second sidewall member to define a at the time of construction a variably selectable width cavity therebetween suitable to receive flowing construction material, the combination comprising:

a multi-piece transverse-connecting member, extending between the first and the second sidewall members, embedded for a one end portion of its length within the first sidewall member, and embedded for an opposite end portion of its length within the second sidewall member, the multi-piece member including a first member portion extending from a region of the first sidewall member which is exterior to the cavity through the substantial thickness of the first sidewall member and into the cavity, a second member portion extending from a region of second sidewall member which is exterior to the cavity through substantial thickness of the second sidewall member and into cavity, and a variably selectable third member portion selectable at time of form erection and wall construction to connect the first member portion and the second member portion over a variably preselected distance to form the multi-piece transverse-connecting member, by which selectable connection of the first sidewall member and the second sidewall member are held at a variably selectably predetermined separation defining the cavity therebetween;

wherein when the poured construction material is used to fill the cavity then a wall is created having the substantial thickness of the length of the multi-piece transverse-connecting member, which length of the multi-piece transverse-connecting member is variably selectable in accordance that its third member portion is variably selectable to be of a variably preselected length;

wherein the wall is of variably selectable predetermined width in accordance the length of the third member portion of the multi-piece transverse-connecting member.

2. The combination self-supporting form according to claim 1 usable with fasteners suitable to attach things to the wall wherein the first member portion of the multi-piece transverse-connecting member comprises:

an integral flange, located in the first sidewall in its region exterior to the cavity, extending transversely relative to an axis of embedding of the multi-piece member within the first sidewall and parallel to the first sidewall member, suitable to receive and to support and to make a fixed mechanical attachment to fasteners that serve to engage the flange from the exterior of the first sidewall member;

wherein any fasteners thus so engaging the flange serve to also to engage not only the first member portion to which the flange is integral, but also to engage the multi-piece member, to engage the first and the second sidewall members, and to engage the wall.

3. The combination self-supporting form of claim 2 further comprising:

an elongate apertured strip that fits between the integral flanges of a number of multi-piece members and the first sidewall, each first member portion of each multi-piece transverse-connecting member passing through an aperture of the apertured strip, the strip being held to a poured wall by the number of multi-piece members, the strip being itself suitable to receive fasteners that serve to engage the strip from the exterior of the first sidewall member;

wherein any fasteners thus so engaging the strip serve to also engage the flanges of the first member portions that hold the strip to the wall, and thus also to engage the multi-piece member, and thus also to engage the first and the second sidewall members, and thus also to engage the wall.

4. The combination self-supporting form of claim 1 wherein the multi-piece transverse-connecting member comprises:

metal.

5. The combination self-supporting form of claim 1 wherein the multi-piece transverse-connecting member's metal comprises:

sheet metal.

6. The combination self-supporting form of claim 1 wherein the multi-piece transverse-connecting member has and presents in its third member portion detents that engage and position a reinforcing bar that is laid horizontally in the cavity of the form atop a number of multi-piece transverse-connecting members at a time before any flowing construction material is poured into the cavity of the form.

7. A building system serving as both a form for a wall made of poured construction material and a permanent surface to the wall once poured, the combination wall-forming and wall-surfacing system comprising:

two substantially planar spaced-parallel construction forms each of rectangular configuration having and defining edges of a relatively longer length aligned horizontally, edges of a relatively shorter length aligned vertically, a respective inner surface directionally disposed to face a corresponding inner surface of the other, spaced-parallel, form and a planar outer surface directionally disposed away from the other, spaced-parallel, form, and a plurality of vertically-extending slots;

a multiplicity of first metal pieces, each of which is sized and adapted so as to fit though a one of the plurality of slots of each of the two forms so as to extend from the form's outer surface to its inner surface, each first metal piece having and defining a flange located at the exterior surface of a form when the metal piece is inserted within a vertical slot of the form, that extends substantially parallel to the exterior surface of the form and transverse to the form's slot so as to both (i) preclude that the metal piece should be possible of being pulled through the form from its exterior to its interior surface, and (ii) present a metal surface that is suitable to attach and to retain a fastener, and an engagement feature, located at the interior surface of a form when the metal piece is inserted within a vertical slot of the form, that is suitably sized and configured so as to be passed through the slot of the form and so as to, when so inserted into a slot, extend beyond the interior surface of the form; and a plurality of variably preselected length second metal pieces, each of which is sized and adapted so as to engage two oppositely-disposed engagement features of two first metal pieces as are respectively inserted into two oppositely-disposed slots of two forms, each second metal piece having and defining two ends, a variably selectively predetermined lineal extent between the two ends, a measure of which extent will determine how far apart the first and the second form are spaced-parallel, and an engagement feature, complimentary to the engagement feature of each of the first pieces, at each end, each of which end engagement features is suitably sized and configured so as to engage, to retain, and to connect the engagement feature of a first metal piece as has been inserted through a form's slot and as extends beyond the form's interior surface;

wherein when the two forms are held spaced parallel at variably preselected separation by the multiplicity of first metal pieces as extend through the plurality of slots of each form, and by the plurality of second metal pieces as engage and retain and connect the first metal pieces, then a poured construction material may be poured to fill a variable-width cavity that is defined between the two spaced parallel forms, the poured construction material capturing in its matrix parts of the first metal pieces and all of the second metal pieces, the poured construction material and creating a wall having the substantial thickness of two first metal pieces and the one preselected second metal piece of variable length and having the two forms as a facing to the wall upon each of its two sides;

wherein regardless of the suitability of the forms to engage and to retain a fastener, at least the flange of each first metal piece, which flange is located at the exterior surface of a form when the metal piece is inserted within a vertical slot of the form, is so suitable to attach and to retain a fastener.

8. A method of constructing a wall of a building upon a level foundation from separate and modular components, the method comprising:

placing a first course of paired opposed substantially planar rectangular forms in a spaced parallel relationship upon the foundation;

inserting first metal pieces from an exterior surface of each form of each opposed pair through slots in each form to, and to extend beyond, an interior surface of the same form, therein to be positionally juxtaposed to a corresponding identical first metal piece lodged in the opposed spaced-parallel form;

connecting with preselected second metal pieces of variable length the juxtaposed first metal pieces, therein locking in position the opposed spaced-parallel forms at a variably preselectably predetermined distance of separation;

repeating the placing, the inserting and the connecting for successive courses of opposed spaced-parallel forms until a vertically standing array of spaced-parallel forms defining a cavity of variably preselected width is created;

pouring a construction material into the cavity between the vertically arrayed spaced-parallel forms, therein to create a wall that consists of forms spaced-parallel at a variably preselectably predetermined distance of separation serving to sandwich a central core of poured building material;

wherein, notably, the thickness of the wall was variably selectably predetermined during its construction by, most notably, preselection of the second metal pieces.

9. The method of constructing a wall of a building according to claim 8 further extended to constructing a higher-story wall upon the top of a lower-story wall, the extended method further comprising:

placing successive courses of the selfsame paired opposed substantially planar rectangular forms in a spaced parallel relationship upon the top of a lower-story wall to define a higher-story wall;

inserting the selfsame first metal pieces in the opposed spaced-parallel forms of each successive course of the higher-story wall; and connecting, with variably preselected second metal pieces of a new length that is shorter than was the length of the second metal pieces of the lower-story wall, the juxtaposed first metal pieces of the higher-story wall; and pouring the same construction material into the cavity between the vertically arrayed spaced-parallel forms defining the higher-story wall as was previously poured in constructing the lower-story wall;

wherein the thickness of the higher-story wall as is determined during its construction by the new-length second metal pieces is less than the thickness of the lower-story wall upon which the higher-story wall rests;

wherein the wall-building method is thus extendable to produce multi-story walls of varying thickness.

10. A wall-building system suitable to receive pourable construction material, the system comprising:

a multiplicity of substantially planar rectangular apertured sidewall panels (i) transportable in stacks, (ii) manually-assembled vertically spaced-parallel in tiered stacks at a wall-building site, and (iii) suitable to form a side surface to a wall; and a multiplicity of transverse connectors of a plurality of differing lengths, the connectors of a preselected one length each being manually insertable through and between opposed apertures of two spaced-parallel sidewall panels so as to hold these two panels in position defining a variably preselected width cavity into which cavity the pourable construction material is poured to make a wall, the transverse connectors of preselected length thus serving to permanently hold the panels at preselected separation as the side surfaces of the wall which wall will be, in accordance with the fact that the connectors were of a preselected one length out of a plurality of lengths, of a preselected width.

11. The wall-building system suitable to receive pourable construction material according to claim 10 built into a two-story building having a wall of a first, relatively wider, width at a first story resultantly from use of a first multiplicity of transverse connectors of a first, relatively longer, length, and having a second, relatively narrower, width at a second story resultantly from use of a second multiplicity of transverse connectors of a second, relatively shorter, length.

* * * * *